United States Patent [19]

Montgomery

[11] 3,973,953

[45]*Aug. 10, 1976

[54] IMAGING METHOD INCLUDING EXPOSURE OF PHOTOCONDUCTIVE IMAGING MEMBER THROUGH LENTICULAR LENS ELEMENT

[75] Inventor: Anthony J. Montgomery, London, England

[73] Assignee: Xerox Corporation, Stamford, Conn.

[ * ] Notice: The portion of the term of this patent subsequent to Oct. 9, 1990, has been disclaimed.

[22] Filed: Dec. 28, 1973

[21] Appl. No.: 429,243

[52] U.S. Cl. ..... 96/1 R; 96/1.1; 96/45; 96/81

[51] Int. Cl.[2] ..... G03G 16/00

[58] Field of Search ..... 96/1 R, 1.1, 45, 81

[56] References Cited

UNITED STATES PATENTS

| | | | |
|---|---|---|---|
| 1,838,173 | 12/1931 | Chretien | 96/45 |
| 2,363,689 | 11/1944 | Rackett | 96/5 |
| 3,542,556 | 11/1970 | Jones | 96/26 |
| 3,543,291 | 11/1970 | Gilfert | 96/33 |
| 3,663,221 | 5/1972 | Higgins et al. | 96/45 |
| 3,764,311 | 10/1973 | Bean | 96/45 |
| 3,817,748 | 6/1974 | Whittaker | 96/1 LY |

*Primary Examiner*—David Klein
*Assistant Examiner*—Judson R. Hightower
*Attorney, Agent, or Firm*—James J. Ralabate; Michael H. Shanahan; George J. Cannon

[57] ABSTRACT

A method is set forth for extending the dynamic range of imagewise exposure systems by transmitting the electromagnetic radiation image through two angularly displaced cylindrical lens arrays and then to a photosensitive surface so that the image at the photosensitive surface is imperfect.

8 Claims, 4 Drawing Figures

IMAGING METHOD INCLUDING EXPOSURE OF PHOTOCONDUCTIVE IMAGING MEMBER THROUGH LENTICULAR LENS ELEMENT

BACKGROUND OF THE INVENTION

The reproduction of continuous tone images is, and has been for a considerable number of years, a major concern in the photographic arts.

A continuous tone image is a positive or negative image, e.g., an opaque print or transparency which is composed of a range of densities from black through gray to white, wherein the grays are formed by forming varying amounts of colorant, e.g., silver compounds, dye or pigment. A continuous tone reproduction contrasts with a line reproduction which is composed of only two tones, black (or a color) and a background color, e.g., white. The same applies to multi-color line images; although there are several colors, each is present only in one depth. The instant invention is directed to a method of half-tone reproduction which simulates a continuous tone image. The term "simulates" is used herein inasmuch as a half-tone image, when viewed at the correct distance, appears to be the result of varying densities. Upon closer examination, however, it becomes obvious that the densities are in fact integrated areas of black and white.

Of the various ways of creating half-tone images, one of the most well known is by screening. A half-tone screen is a line or dot pattern used to convert the continuous tones of varying darkness in a photograph, etc., into a discontinuous pattern of constant density buty varying area. In a half-tone image lighter or darker tones are reproduced by smaller or larger dots or lines — which, through being uniformly spaced, occupy a greater or lesser proportion of a given unit area.

Half-tone images can be produced in many ways; the most usual is to convert the continuous tone into a regular dot pattern. In the past, several different structures have been used to produce this pattern, e.g., cross-line screens, gauze, linen and wire. When a single cylindrical lenticular lens is used to create a soft line pattern on an imaging member, a "zipper-toned" image is created which is closely related to the well-known soft dot pattern.

The instant invention calls for the use of a lens system for producing the screening effects set forth above. A perfect lens is one which most nearly shows an image of a point as a point and a straight line as a straight line, subject to the faults, or aberrations, inherent in any lens which tend to reproduce a point as a patch, and a straight line as a more or less curved band.

Aberrations which affect an image point on the axis of the lens are classified as axial aberrations. The principal axial aberrations are chromatic and spherical.

Chromatic aberrations merely reflect the fact that a single lens made from a single type of an optical glass will refract blue rays more strongly than green rays, which in turn are refracted more strongly than red rays. Thus, a three-dimensional spacial positioning of the colored rays results and is referred to as chromatic aberration. Spherical aberration involves the phenomenon that rays coming from an object on the axis of a lens and going through the center of the lens come to a focus at a certain point on the axis of the lens. Rays from an axial object going through the lens near the edges should come to a focus at the same point, but in practice, because of spherical aberration, they tend to come toward a different point of focus. The difference between these focal points is the spherical aberration of the lens. Spherical aberration increases with the lens aperture. In a simple conveying lens, spherical aberration causes the rays farthest from the lens axis to convert more strongly, and to come to a focus nearer the lens than the central rays close to the lens axis. The image is never fully sharp. Spherical aberration does not vary with image size, but with the square of the aperture.

One additional known method used to screen images is the employment of a lenticular lens array. Such an array is one which uses a lenticular screen to break up an image into linear and area components which are subsequently recombined. The purpose of splitting is usually to accommodate two or more images interspersed in each other on the same area. Uses of a lenticular screen or lenticular array are usually for lenticular color photography, stero photography, image disection and multiple image storage. For example, see U.S. Pat. No. 3,413,117, which, in FIG. 7, discloses the use of a lenticular screen in an image deformation system. This patent is specifically concerned with the formation of color images in a thermoplastic deformation system, and requires the creation of relatively perfect images on the surface of the imaging member. The perfection of the image is indicated by the statement therein that ". . . light incident upon each area under each lens-like embossing 36 reacts with the recording layer to provide a stress pattern having a point-to-point correspondence with the image pattern . . . ." Furthermore, it is noted that this patent specifically calls for contact between the lenticular element and the image receiving surface, and that the read-out system is illumination through the film and lens with, or without, Schlieren optics. Also see U.S. Pat. Nos. 1,746,584, 992,151 and 1,749,278.

Generally, the main component of a lenticular system is the lenticular screen itself, consisting of a transparent support embossed with a regular pattern of lens surfaces. A cylindrical lenticular lens is one which has a regular pattern of lens surfaces running in one direction as strips. While several obvious materials are suitable for construction of such a lens, usually they are made of plastic. Additionally, it should be noted that lenses of this type can be made by any of a number of processes including embossing, casting and extrusion.

When a lenticular screen is placed in front of, and in contact with, the surface on which the camera lens projects an image, the individual lenticular elements break up the image into lines or points. They concentrate the image components into a smaller area, leaving spaces between them. Additional images can be recorded in the spaces by slightly displacing the lens laterally or by moving the object in front of the lens. The record or recorded image then contains a series of interlaced images which can be reconstituted by observation through a similar lenticular screen. The lenticular screen breaks up the image into line elements with spaces in between. If the screen is moved, a new set of line elements is formed in the spaces between the first set.

BRIEF DESCRIPTION OF THE INVENTION

It is an object of this invention to provide a method of extending the dynamic range of imagewise exposure systems.

It is a further object of this invention to provide a method of screening continuous tone images.

It is a further object of this invention to provide a method of screening continuous tone images using lenticular elements either out of, or in, contact with the imaging member.

It is a still further object of this invention to provide a method of screening continuous tone images wherein the loss of light due to reflection or absorption of light by the screen is, for all practical purposes, eliminated.

It is an even still further object of this invention to provide a method of screening which requires the creation of imperfect images of the imaging lens on the photosensitive surface of the imaging member.

These, and other, objects are obtained by providing a method for extending the dynamic range of imagewise exposure systems by transmitting the electromagnetic radiation image through two angularly displaced cylindrical lens arrays and then to a photosensitive surface so that the image at the photosensitive surface is imperfect.

DESCRIPTION OF THE PREFERRED EMBODIMENTS

Figure 1:
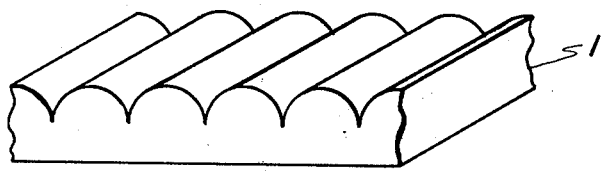
FIG. 1 is a partially schematic, partially cross-sectional view of a cylindrical-type lenticular lens element.

As stated above, lenticular elements are not new in photographic screening systems. FIG. 1 is a schematic of the well-known cylindrical lenticular lens with uniform elements running parallel in one direction.

Most of the methods that increase the tonal information in a given photograhic system are inefficient. The inefficiency is caused by the opaque optical screen or optical filter which must absorb or reflect some of the light so that the highlights are not "burned out" by the longer exposure time required. The lens of the instant invention does not exhibit these characteristics inasmuch as it transmits substantially all radiation presented to it to the imaging member.

Figure 2:
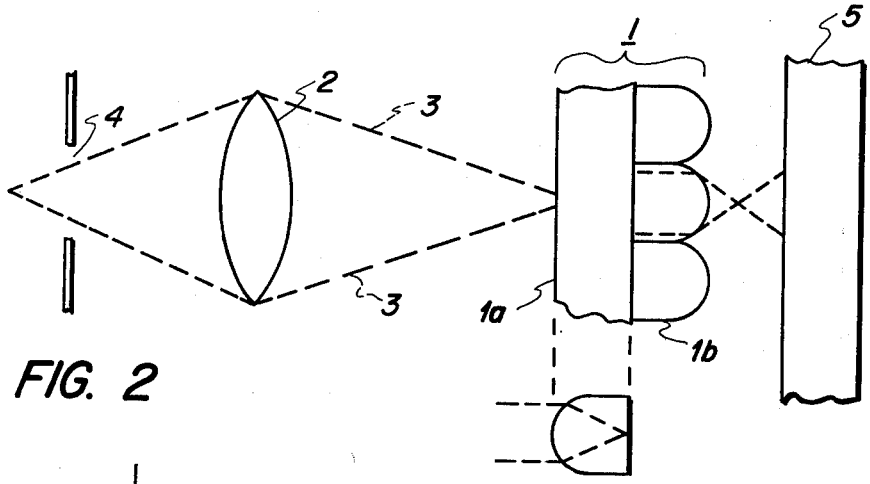
FIG. 2 is a schematic diagram of an imaging system employing the method of the instant invention.

The half-tone image reproduction system herein proposed is of much higher efficiency than the prior art systems described above. Attention is directed to FIG. 2 wherein one embodiment of the system of the instant invention is shown. An imaging lens 2, which images electromagnetic radiation, e.g., light rays 3, through aperture 4, is positioned adjacent composite lenticular element 1. Composite element 1 comprises two lenticular lens arrays, 1*a* and 1*b*, which have their lenses running at angles to each other. The composite element 1 is interposed between lens 2 and the light image receiving surface 5 which is photosensitive to radiation 3. Note that the lenticular element 1*b* is not in contact with the image receiving surface 5, but rather is spaced some distance therefrom. This distance is determined by the various structural parameters of the composite element 1 and can take any practical value so long as the image remains imperfect.

In FIG. 2, composite element 1 is shown as being made up of two lens arrays facing in opposite direction. The instant invention is not limited to such an arrangement, but rather includes all four possible relative positions. Furthermore, composite element 1 can be made of separable lens arrays, or, in the alternative, can be a single structure with arrays 1*a* and 1*b* on opposite faces thereof.

Basically, each lenslet formed by a combination of a part of 1*a* with the corresponding part of 1*b* forms an image of aperture 4 on the photosensitive element 5. If this image were perfect, that is without aberration, its linear dimension would be smaller than the line spacing of cylindrical lens array 1*a* or 1*b*. Aberration is designed into elements 1*a* and 1*b* so that the distribution of light on the photosensitive element is controlled to be a series of soft dots. The controlled focusing of a perfect lens may produce the same result.

The relative spacings, array to array and array to imaging member, can take any practical values depending upon the focal length and other optical parameters of the various arrays. Generally, however, the distance between arrays should be kept to a minimum for best results.

Since the invention is concerned with half-toned reproduction, it is necessary that the screening structure produce the well-known soft dot pattern, i.e., a dot of varying intensity from the center to the edge. A lenticular element which produces perfect images provides a system with high sensitivity (see copending U.S. pat. applications: Ser. Nos. 429,446 and 429,445, both filed on Dec. 28, 1973, while a lenticular element which produces imperfect images (see copending U.S. pat. application Ser. No. 429,253, filed on Dec. 28, 1973 provides a system with greater acceptance, i.e., extended range. A lenticular element which produces an imperfect image does not focus the impinging light into a sharp dot, but rather creates one which is of varying intensity as explained below in regard to FIG. 3.

Basically, there are two ways in which to create the above-described "imperfect image". One is to use an optically good composite element 1 and intentionally locate it out of focus with the surface of photosensitive member 5. The other is to use an optically imperfect composite element 1 in relative focus with the surface. An optically good lens out of focus would be one in such a condition that its resolution limit is significantly less than the number of lenticules per inch. On the other hand, an optically poor lens is one of such quality that the resolution of a given lenticule, in line pairs per millimeter, is less than or equal to the lens frequency in line pairs per millimeter.

The design of the dot pattern created by the multiple lens arrays of the instant invention is determined by the relative angle between the two arrays 1*a* and 1*b*. By varying the angle between 90° and 0° the dots change from circular to ellipsoidial.

Figure 3:
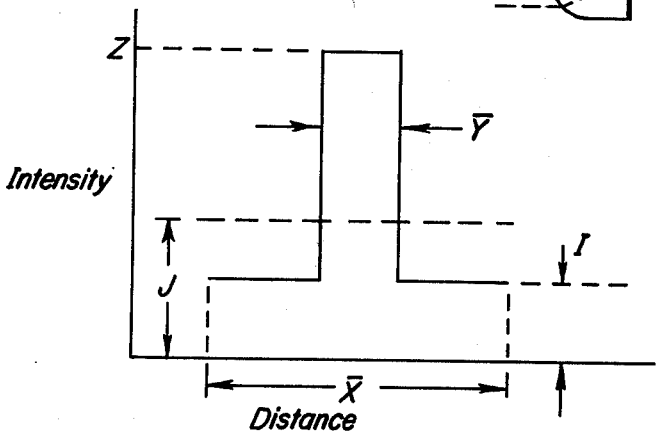
FIG. 3 is a graph showing the idealized variation in light intensity across the imaging member when processed according to the instant invention.

The Intensity vs. Distance graph of FIG. 3 exemplifies the ideal characteristics of cylindrical lens arrays according to the instant invention. The image outside the lenticule is such that in one quarter ($\bar{Y}$) of the distance under the lens ($\bar{X}$), the intensity is approximately 4 times greater than the intensity of the remaining three-fourths of the distance, and that the intensity of the three-fourths of the area is reduced from about 1.75 units (J) to about 1.0 units (I). In other words the distance I is 0.75 density units smaller than the intensity without the lens J.

Further by way of example, let us look at the exposure of an amorphous selenium photoconductive layer of the type used in conventional commercial xerography using arrays of cylindrical lenticulated lenses. Amorphous selenium xerography has a density input range of approximately 0.6 density units which, when used with the concepts of the instant invention, will be increased to about 1.2 density units. The three-fourths of the area under the lenticule which received one-fourth of the density will be used to record the shadow information and the remaining one-fourth of the area will be used to record the highlight information.

Figure 4:
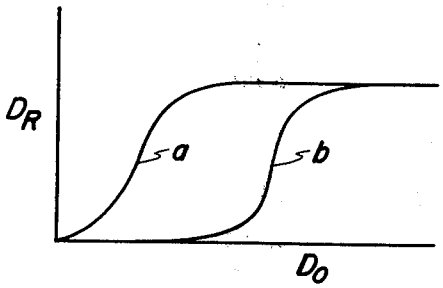
FIG. 4 is a graph showing the relationship between the original density and the reproduction density of an exemplary imaging system undergoing different exposures corresponding to different density ranges.

For a better understanding of the concepts and value of the instant invention, attention is directed to the graph of FIG. 4 which shows the relationship between the density of the original, $D_O$, and the density of the reproduction, $D_R$, in an unscreened system. It is helpful to compare this graph with the one of FIG. 3 and consider the imaging members to be the same except that, as noted previously, FIG. 3 represents results obtained in a screened system and FIG. 4 represents results obtained in an unscreened system. Using the same exposure as used in FIG. 3 produces a density relationship according to curve *a*, which reaches a maximum value corresponding to the dotted line J in FIG. 3. The copy content represented by curve a *a* useful in reproduction systems; however, it does not have the capability of reproducing the highlight information of the original. Now, if a higher level of exposure is used, a density relationship according to curve *b* is produced which also reaches a maximum value and corresponds to value Z in FIG. 3. Note that the curve *b* represents a higher density of the original, and, obviously contains more highlight information. In other words, curve *b* contains highlight information which curve *a* does not, but does not contain the same amount of shadow information.

Therefore, it can be seen that exposure through the inventive screen will give density information covering an extended range greater than any single exposure level taken alone.

The lens can be designed to give any type of quasi-step function or continuous curve to give the desired half-tone image.

The quality of the image presented to the photosensitive surfce of the imaging member is important to the instant invention. The prior art systems are all directed to the transmission of an image which is as near perfect as possible, while the instant invention intentionally does contrary. The desired imperfect image is obtained by either using optically good lenticular lens arrays out of focus, or optically poor lenticular lens arrays substantially in focus. In the former situation, it is also possible to vary the size of the dot by moving the lens elements with respect to the recording medium.

Composite lenticular element 1 is illustrated in the figures as being out of contact with the imaging member; however, it is important to note that embodiments can be made which have contact between the two elements and in which they form an integral member. It is important only that an imperfect image can be created.

The developed image is normally viewed otherwise than through the lenticular lens array. This is especially true in the embodiments wherein there is no contact between the array and the imaging member.

Generally, there is no limitation on the number of lenticules per millimeter; however, a preferred mode would require the number of lenticules per inch to have about 2½ times the frequency of the image to be resolved.

The system of the instant invention produces, at the expense of resolution, an increase in density input which is equal to the density difference between light and dark areas. Or, more specifically, the increase equals $\log_{10}$ of the ratio of the maximum intensity and minimum intensity of the lens.

As noted herein, lenticular lenses are not new in the art and can be purchased to order from numerous sources, for example, Photosystems Corporation of Hauppauge, N.Y.

The advantageous invention of the instant application can be applied to any photosensitive imaging system. Photosensitive imaging members include all such members which attribute their functionability to a sensitivity to activating radiation.

Although specific apparatus and process steps have been described, other elements and steps may be used where suitable.

It will be understood that various changes in details, materials, steps and arrangements of parts, which have herein been described and illustrated in order to explain the nature of the invention, will occur to and, may be made by those skilled in the art upon a reading of the disclosure within the principles and scope of the invention.

What is claimed is:

1. A method for extending the dynamic range of an imagewise exposure system comprising the steps of:

a. providing a photosensitive member; and b. imagewise exposing said photosensitive member to activating electromagnetic radiation through a lenticular lens element out of focus with said photosensitive member, said lenticular element comprising two angularly displaced layers of cylindrical lens arrays and providing on said photosensitive member during said imagewise exposure a soft dot pattern wherein about 75% of the photosensitive member area under each lenticule receives shadow information at a density of about 25% of the highlight information density received by the central about 25% of the photosensitive imaging member area under each lenticule.

2. The method of claim 1 wherein said lens arrays are cylindrical.

3. The method of claim 1 wherein said angular displacement is in the range between above 0° and about 90°.

4. The method of claim 1 wherein said lenticular element is out of contact with said imaging member.

5. The method of claim 1 wherein said photosensitive imaging member is a xerographic photoreceptor.

6. The method of claim 1 wherein said photosensitive imaging member is also deformable.

7. The method of claim 1 wherein said photosensitive imaging member is a silver halide photographic film.

8. The method of claim 4 wherein said photosensitive imaging member is a xerographic photoreceptor.

* * * * *